US005159618A

United States Patent [19]

Blake

[11] Patent Number: 5,159,618

[45] Date of Patent: Oct. 27, 1992

[54] X-RAY TUBE ENCLOSURE WITH RESISTIVE COATING

[75] Inventor: James A. Blake, Franklin, Wis.

[73] Assignee: General Electric Company, Milwaukee, Wis.

[21] Appl. No.: 703,947

[22] Filed: May 22, 1991

[51] Int. Cl.[5] ..... H01J 35/02

[52] U.S. Cl. ..... 378/139; 378/121; 378/201; 313/479; 331/97

[58] Field of Search ..... 378/139, 121, 140, 201, 378/193, 203; 315/248, 39; 313/479, 317, 324; 331/96, 97

[56] References Cited

U.S. PATENT DOCUMENTS 2,504,706 4/1950 Lempert et al. ..... 378/139
3,465,154 9/1969 Berends ..... 378/201
4,284,922 8/1981 Perring et al. ..... 315/5.43
5,030,935 7/1991 Williams et al. ..... 333/246

FOREIGN PATENT DOCUMENTS 0134377 7/1933 Fed. Rep. of Germany ..... 378/201

*Primary Examiner*—David P. Porta
*Attorney, Agent, or Firm*—Quarles & Brady

[57] ABSTRACT

A X-ray emissive vacuum tube is fully enclosed in an electrically conductive casing with electrical terminals through which bias potentials are applied to the tube. Occasionally an arc discharge occurs between electrodes within the tube generating a high frequency signal which ordinarily resonates with the conventional casings. However a resistive coating is applied to the inner surface of the case. That coating has a resistivity sufficient to lower the Q of the case to a value at which significant ringing does not result from the discharge.

9 Claims, 2 Drawing Sheets

X-RAY TUBE ENCLOSURE WITH RESISTIVE COATING

BACKGROUND OF THE INVENTION

The present invention relates to shielded metal enclosures for electronic components; and specifically to such enclosures for housing an X-ray tube in an imaging system.

An X-ray imaging apparatus includes a vacuum tube with a cathode and anode that emits X-rays upon application of bias voltages to electrodes within the tube. The X-ray tube typically is enclosed in a grounded lead alloy enclosure which act as an X-ray shield. A major problem during the operation of X-ray tubes is high voltage discharge or arcing between the electrodes. The discharges, commonly known as "spits", result from intense electric field gradients caused by contamination or rough edges on the surfaces of the electrodes and occur from time to time during the life of the tube.

The spit discharge excites a resonant cavity tank circuit formed by the X-ray tube and the conductive enclosure, thereby producing a high frequency (3 to 300 megahertz) damped signal. The high frequency signal from a spit discharge is conducted through the case by the electrical conductors that provide power to the tube. Once outside the enclosure, the signal is radiated and conducted throughout the X-ray apparatus and into electronic circuitry in its vicinity. In extreme cases, the electrical signal from the spits causes failure of semiconductor devices in adjacent equipment.

SUMMARY OF THE INVENTION

An assembly for an X-ray imaging system uses a vacuum tube which emits X-radiation when properly excited. The vacuum tube is enclosed in an electrically conductive housing. A pair of electrical terminals extend through walls of the housing and are insulated therefrom. The terminals are connected to an anode and a cathode of the vacuum tube.

A resistive coating is applied to the interior surface of the housing. The coating has a resistivity that is sufficient to lower the Q of the tube's resonant cavity below a value at which a high frequency signal, produced by an arc discharge across the anode and the cathode, can produce significant ringing between the vacuum tube and the housing. For example, the coating can be a graphite material similar to coatings on interior surfaces of television picture tube envelopes.

DESCRIPTION OF THE PRESENT INVENTION

Figure 1:
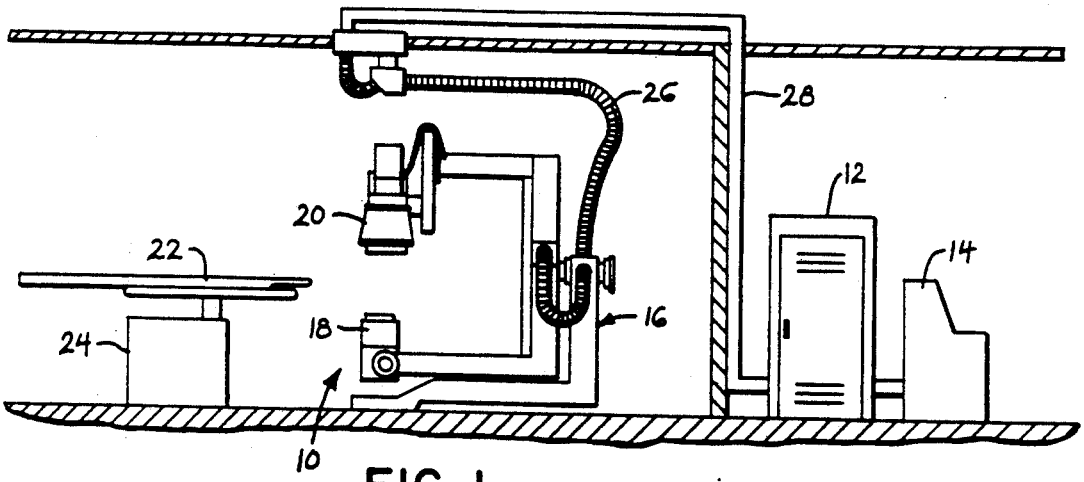
FIG. 1 is a pictorial representation of an X-ray imaging system incorporating the present invention.

With reference to FIG. 1, an X-ray imaging apparatus 10 is illustrated installed in two rooms of a building, such as a hospital or medical clinic. Within one room is a power supply 12 and an operator control console 14. Typically, the power supply 12 includes several low and high voltage supplies.

Within the other room is a gantry 16 on which an X-ray emitter housing 18 and X-ray detection assembly 20 are mounted. The X-ray detection assembly 20 consists of a film holder, a video camera or an X-ray detector which converts X-rays into electrical signals. Electrical cables, carrying power and control signals, extend through a flexible conduit 26 and a rigid conduit 28 from the components mounted on the gantry 16 to the power supply 12 and the control console 14.

An X-ray transmissive table 22, for supporting a patient being examined, is positioned adjacent to the gantry 16. The table 22 is mounted on a support 24 in a manner that allows the table to slide between the X-ray emitter housing 18 and detection assembly 20.

Figure 2:
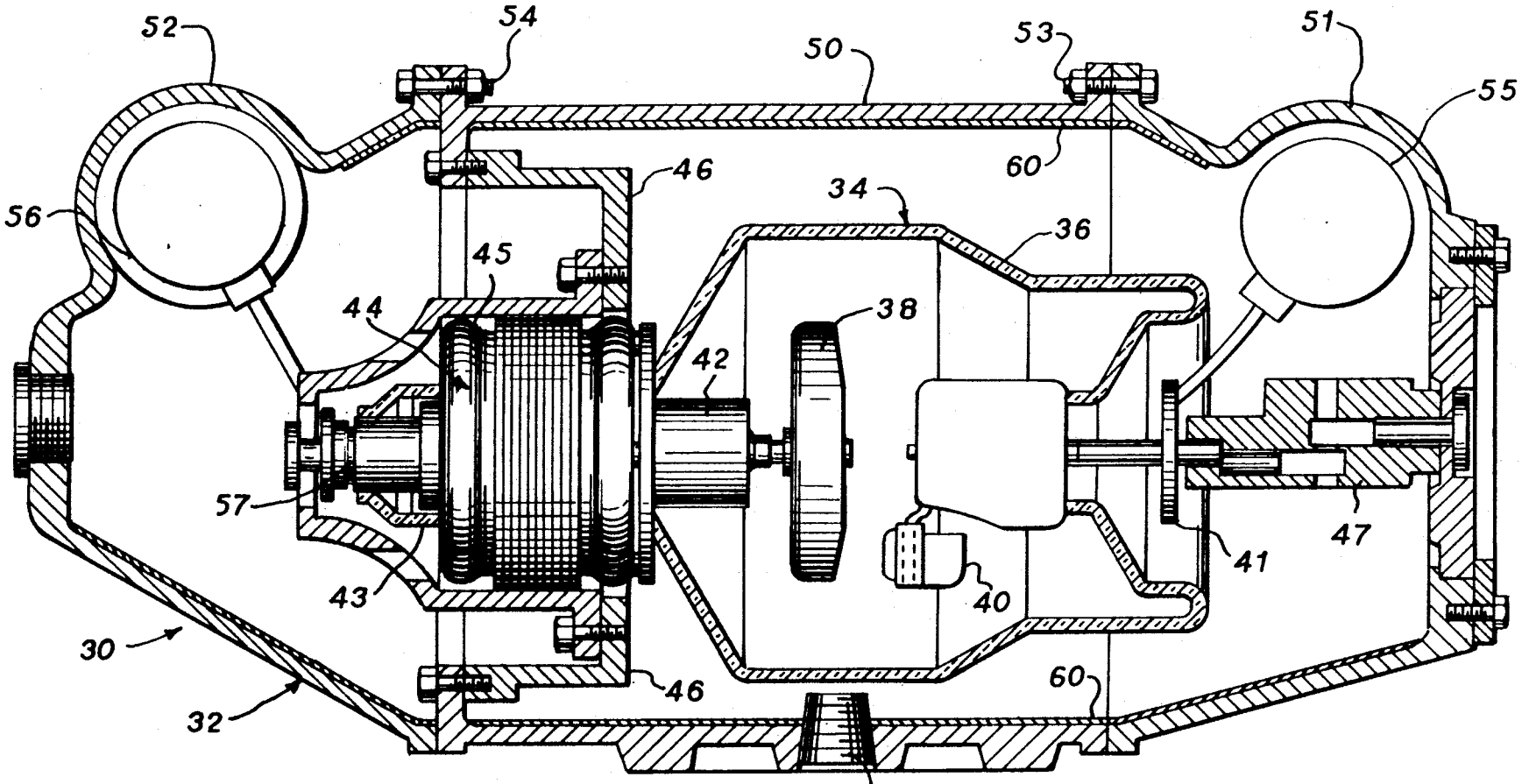
FIG. 2 is a cross-sectional view through an X-ray tube assembly utilized in FIG. 1.

The emitter housing 18 contains an X-ray tube assembly 30, shown in FIG. 2, which comprises an outer case 32 enclosing an X-ray vacuum tube 34. The vacuum tube 34 has an outer glass envelope 36 containing an anode 38 and a cathode assembly 40. The cathode assembly 40 includes a conventional thermionic emissive cathode and a filament which heats the cathode to a temperature at which it will emit electrons when properly biased. The cathode assembly 40 is coupled to an external cathode terminal 41.

The disk-shaped anode 38 is fabricated of conventional material that emits X-radiation upon electron bombardment. The anode 38 is attached to a rotor 42 within a neck 43 of the X-ray tube envelope 36. The rotor 42 is part of a motor 44 which also includes an annular stator 45 positioned around the exterior of an X-ray tube neck. When current is applied to coils of the stator 45, a rotating magnetic field is produced within the X-ray tube neck. The magnetic field causes the rotor 42 and the anode 38 to spin.

The X-ray tube 34 and motor 44 are mounted within the cylindrical case 32 by a plurality of supports 46 and 47. The case 32 is formed of a lead alloy which provides a conductive enclosure surrounding the X-ray tube that is substantially impervious to stray X-rays produced within the assembly. The case 32 comprises three segments 50, 51 and 52 which are coupled together to form a unified, contiguous shield around the tube 34. A tubular center segment 50 extends around the majority of the X-ray tube 34 and has a window 48 through which the X-rays emitted from the anode pass. A cup-shaped cathode end segment 51 is fixedly attached by bolts 53 across the end of the center segment 50, adjacent the cathode terminal 41 of the X-ray tube 34. A first high voltage connector 55 extends through a wall of the cathode end segment 51 and is electrically insulated from the case 32. The first high voltage connector 55 is adapted to receive a high negative cathode bias potential and is connected to the cathode terminal 41. A filament current may also be applied to the cathode assembly 40 via connector 55.

A cup-shaped anode end segment 52 extends across and is coupled to the other end of the center section 50 by bolts 54. A second high voltage connector 56 extends through a wall of the anode end segment 52 and is electrically insulated from the case 32. The second high voltage connector 56 is adapted to receive a high positive anode bias potential and is connected to the anode 38 of the X-ray tube 34 via a rotor mount 57 extending through the glass envelope 36. The cables from the power supply 12 (FIG. 1) connect to the two high voltage connectors 55 and 56.

Figure 3:
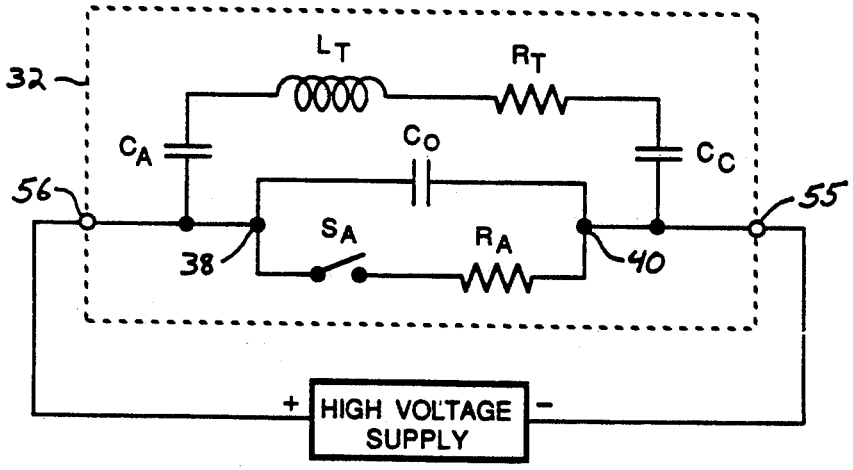
FIG. 3 is the equivalent electrical circuit of the tube assembly in FIG. 2.

FIG. 3 shows an equivalent circuit for the electrical characteristics of the X-ray tube 34 and case 32. The anode 38 and cathode assembly 40 present a capacitance $C_O$ between the two high voltage connectors 55 and 56.

The magnitude of capacitance $C_O$ depends upon the diameter of the anode 38, the surface area of the cathode assembly 40, the anode to cathode spacing, and other fringe effects. When a high voltage spit discharge occurs, an arc is established between the anode and cathode. This arc is equivalent to a momentary short circuit having some resistance, as indicated by serially connected switch $S_A$ and resistor $R_A$ in parallel with capacitance $C_O$.

The insulation of each high voltage connector 55 and 56 from the case 32 establishes a capacitance between those components. This capacitance is represented in the equivalent circuit by capacitance $C_A$ at the anode end of the tube and capacitance $C_C$ at the cathode end. The magnitudes of capacitances $C_A$ and $C_C$ are much greater than the anode to cathode capacitance $C_O$ and for the purposes of simplification are considered to be a short circuit at the high frequencies produced by a spit discharge. Connector capacitances $C_A$ and $C_C$ couple the high frequency spit discharge signal to the case 32. The internal surface of the cylindrical case provides a series of parallel conductive paths for this signal between the two high voltage connectors 55 and 56. These paths are collectively represented by an inductance $L_T$ in series with a surface resistance $R_T$.

Equivalent circuit components $C_A$, $C_C$, $L_T$ and $R_T$ along with capacitance $C_O$ form a parallel resonant cavity tank circuit Since the resistance $R_T$ for conventional cases was very low (approaching zero ohms), the quality factor "Q" of the tank circuit was very high. The quality factor is given by $Q=(2\pi f\ L_T)/R_T$. When an arc discharge occurs, switch $S_A$ in the equivalent Circuit momentarily closes and the voltage across $C_O$ changes rapidly. This excites a resonant cavity tank circuit formed primarily by components $C_O$ and $L_T$ and causes the circuit to ring. The ringing current has the form of a damped high frequency oscillation with a decay period determined by the Q of the circuit. The higher the Q, the longer the decay period. The magnitude of the circulating current also is proportional to the Q of the circuit.

The present invention provides a resistive coating 60 on the inside surface of the case 32. The coating 60 can be applied to the interior surfaces of all three case segments 50, 51 and 52, or just to the center segment 50. For example, a graphite coating similar to that used to coat the interior surface of a television picture tube envelope can be applied to the internal surface of case 32. The resistive coating 60 is relatively thin, since the high frequency current is a skin effect phenomenon. As such the coating thickness is dependent upon the resonant frequency of the cavity. The resistivity of the resistive coating 60 is preferably in the range 1 to 100,000 ohms per square centimeter.

The resistive coating 60 increases the value of $R_T$ in the equivalent circuit, which reduces the Q of the resonant cavity system. By lowering the Q, the electrical ringing will be reduced in amplitude and duration when a spit discharge occurs. Most of the high frequency energy from the signal produced by the spit discharge is dissipated as heat in the resistive coating and is not radiated or conducted outside the case 32.

The invention being claimed is:

1. An assembly for an X-ray imaging system comprising:

a vacuum tube having a cathode and an anode which emits X-radiation upon excitation of said vacuum tube;

an electrically conductive case enclosing said vacuum tube and having first and second electrical terminals extending through said case and insulated therefrom, each of the terminals connected to a different one of the anode and the cathode; and a resistive coating, on the interior surface of said case, to reduce the quality factor Q of a resonant cavity formed by said case and said vacuum tube.

2. The assembly for an X-ray imaging system as recited in claim 1 wherein said coating has a resistivity which reduces the quality factor Q at a resonant frequency of the cavity to a minimum attainable value.

3. The assembly for an X-ray imaging system as recited in claim 1 wherein said coating has a resistivity in the range 1 to 100,000 ohms per square centimeter.

4. The assembly for an X-ray imaging system as recited in claim 1 wherein said coating has a thickness which minimizes the quality factor Q at a resonant frequency of the cavity.

5. The assembly for an X-ray imaging system as recited in claim 1 wherein said coating reduces the quality factor Q of the resonant cavity below a value at which an arc discharge across the anode and the cathode produces signal ringing between said vacuum tube and said case.

6. An assembly comprising:

a device which produces a high frequency signal;

an electrically conductive case enclosing said device and having a means for transmitting electricity through a wall of said case to said device, said device and said case forming a resonant cavity; and a resistive coating applied to the interior surface of said case to lower the quality factor Q of the resonant cavity and reduce signal ringing within said case.

7. The assembly as recited in claim 6 wherein said coating has a resistivity which reduces of the quality factor Q at a resonant frequency of the cavity to a minimum value.

8. The assembly as recited in claim 6 wherein said coating has a resistivity in the range 1 to 100,000 ohms per square centimeter.

9. The assembly as recited in claim 6 wherein said coating has a thickness which minimizes the quality factor Q at a resonant frequency of the cavity.

* * * * *